US010441131B2

(12) United States Patent
Frontera

(10) Patent No.: US 10,441,131 B2
(45) Date of Patent: Oct. 15, 2019

(54) SCRUBBER/SCRAPER SPONGE

(71) Applicant: Giovanni Frontera, Newburgh, NY (US)

(72) Inventor: Giovanni Frontera, Newburgh, NY (US)

( * ) Notice: Subject to any disclaimer, the term of this patent is extended or adjusted under 35 U.S.C. 154(b) by 38 days.

(21) Appl. No.: 15/862,377

(22) Filed: Jan. 4, 2018

(65) Prior Publication Data

US 2019/0200842 A1 Jul. 4, 2019

(51) Int. Cl.

| | |
|---|---|
| ***A47L 17/06*** | (2006.01) |
| ***A47L 17/08*** | (2006.01) |
| ***A47L 13/16*** | (2006.01) |
| ***A47L 13/08*** | (2006.01) |

(52) U.S. Cl.

CPC ..... *A47L 17/06* (2013.01); *A47L 13/08* (2013.01); *A47L 13/16* (2013.01); *A47L 17/08* (2013.01)

(58) Field of Classification Search

CPC ..... A47L 17/06; A47L 13/08; A47L 13/16; A47L 17/08

See application file for complete search history.

(56) References Cited

U.S. PATENT DOCUMENTS

| | | | | |
|---|---|---|---|---|
| 1,822,725 | A * | 9/1931 | Cooper | A47L 13/257 15/105 |
| 3,629,896 | A | 12/1971 | Simec | |
| 9,297,170 | B1 * | 3/2016 | Jones | E04F 21/1655 |
| 2008/0216260 | A1 * | 9/2008 | Silverman | A47L 13/022 15/105 |

* cited by examiner

*Primary Examiner* — Shay Karls

(57) ABSTRACT

The invention is directed to a scrubber/scraper sponge. The sponge is comprised of three layers. A lower sponge layer provides a soft, absorbent washing surface on the bottom surface of the sponge. An upper abrasive layer provides a scrubbing surface on the top surface of the sponge. The front peripheral edge of the sponge provides a scraping edge on a scraping layer, which extends partially from the front edge toward the rear edge of the sponge, between the sponge layer and the abrasive layer. Flexible barbs extend rearward from the rear edge of the scraping layer, such that the barbs become embedded in the sponge layer during the manufacturing process and firmly secure the scraping layer to the sponge layer.

7 Claims, 3 Drawing Sheets

FIG.8
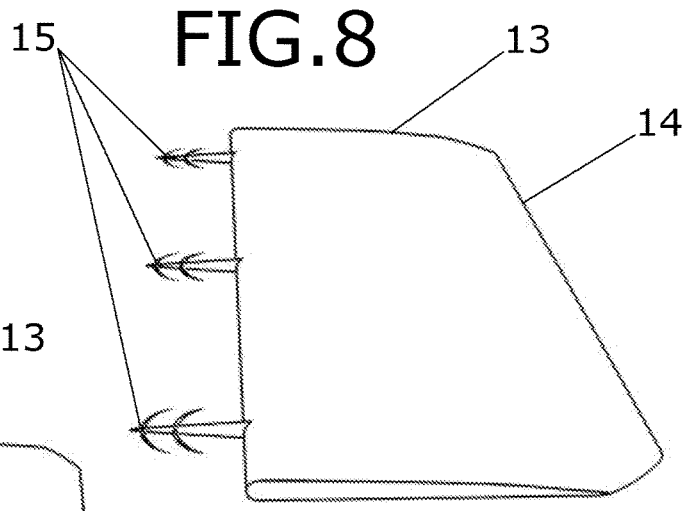
FIG.7
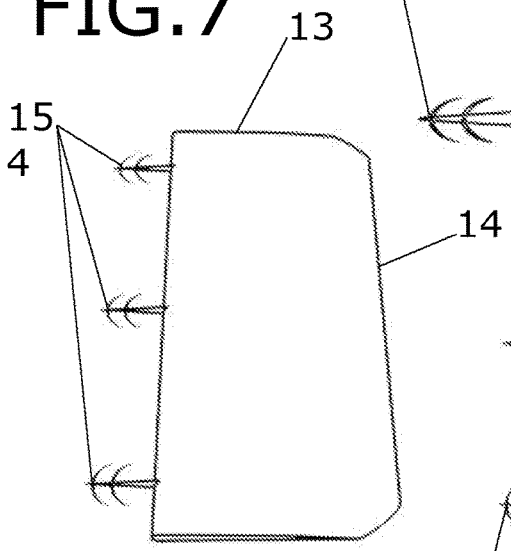
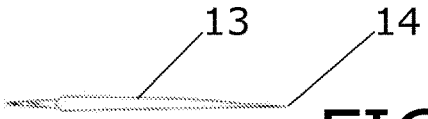
FIG.9
FIG.10
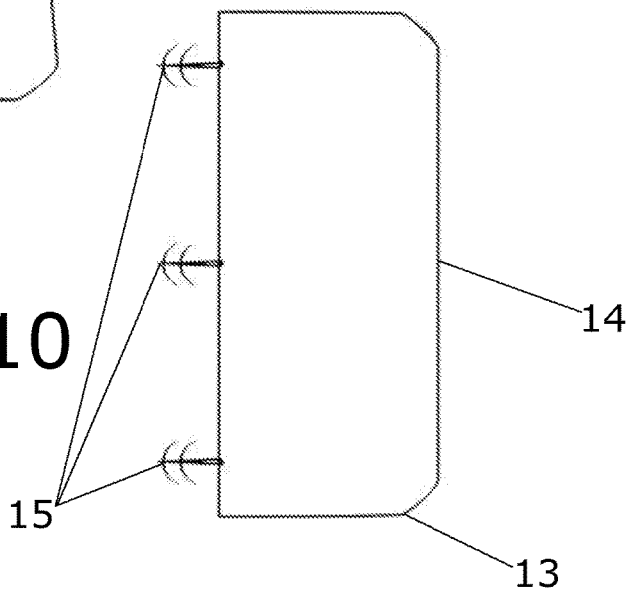

SCRUBBER/SCRAPER SPONGE

CROSS-REFERENCE TO RELATED APPLICATIONS

This application relates back to, and claims the priority of Provisional Patent Application No. 62/498,682 filed on Jan. 5, 2017.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to cleaning equipment and supplies, and in particular to a scrubber/scraper sponge. For millions of workers in the restaurant and delicatessen business, as well as millions of homeowners, washing dishes is an exhausting and time consuming chore. The discarded food must be scraped off the dishes with a hard, but preferably flexible edge. Both an abrasive surface and a softer, absorbent surface are useful when washing the dishes.

A search of the prior art reveals various devices which have been developed to provide the features of a hard, but preferably flexible edge; an abrasive surface; and a softer, absorbent surface in a single cleaning device. None are closely related to the present invention, but several include features which resemble those of the present invention. Each has proven to be less than satisfactory for the present purpose in its own way.

Combined washing, drying, scrubbing and scraping implement, U.S. Pat. No. 3,629,896 (priority Mar. 23, 1970, provides a cleaning article which includes a washing member, such as a sponge, having a recess in one peripheral edge thereof and with a cover member having an edge portion secured in the recess, the cover member being adapted to be wrapped around the washing member or to be disposed in outwardly extending relation thereto, as desired.

Spatula with sponge scourer, Japanese Patent No. JP4262473B2 (priority Dec. 24, 2002), provides a porous sponge portion where the rectangular parallel piped shape in one direction having compressibility and water absorption, and an elastic spatula portion extending from one end of the sponge's spatula part, by densifying by compressing an end portion of the sponge portion partially spatula with scrubbing pad, characterized by being formed integrally with the sponge portion at one end in the longitudinal direction of the sponge portion.

Scraper sponge, U.S. Patent Appl. No. 2008/0216260 (priority Mar. 9, 2007), provides a scraper sponge for cleaning and scraping away unwanted substances from an object or surface comprising a sponge body defining a first surface and a second surface opposite the first surface and a scraper secured to one of the first and second surfaces. As an alternative, the sponge body defines an aperture for securing the scraper therein. The scraper has a tip portion defining at least one edge and a depressible surface to which forces are applied to manipulate the scraper. The edge is narrow and adapted for entering corners, grooves and crevices and for scraping surfaces. The scraper is at least semi rigid and the depressible surface is contoured to facilitate effective scraping. The sponge body has at least one surface adapted for cleaning and scouring and is usable with or without the scraper.

Sponge scrub brush for automobile washing, Japanese Patent No. JP2014159179A (priority Feb. 19, 2013), provides an upper layer, a middle layer and a lower layer of foam and is laminated in a three-layer structure. A concavo-convex shape is provided on the side surface opposite to the middle layer contact surface of the upper layer. The upper and middle layers are composed of polyurethane foam subjected to a film removal treatment. There are provided a plurality of cross-like slits or holes directed from the surface in contact with the upper layer toward the back surface in contact with the lower layer.

Some of the prior art inventions present certain disadvantages. The present invention has been developed for the purpose of addressing and resolving these disadvantages, by providing a sturdy scraping and scrubbing device which is long-lasting, inexpensive, and economical to use. A scrubber/scraper sponge, which provides a semi-rigid edge for scraping and absorbent and abrasive surfaces for scrubbing and washing, would resolve this problem.

SUMMARY OF THE INVENTION

Accordingly, the invention is directed to a scrubber/scraper sponge. The sponge is comprised of three layers. A lower sponge layer provides a soft, absorbent washing surface on the bottom surface of the sponge. An upper abrasive layer provides a scrubbing surface on the top surface of the sponge. The front peripheral edge of the sponge provides a scraping edge on a scraping layer, which extends partially from the front edge toward the rear edge of the sponge, between the sponge layer and the abrasive layer. Flexible barbs extend rearward from the rear edge of the scraping layer, such that the barbs become embedded in the sponge layer during the manufacturing process and firmly secure the scraping layer to the sponge layer.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

FIG. 7 shows a side perspective view of the scraping layer of the first exemplary embodiment, displaying the scraping layer 13, the scraping edge 14, and the barbs 15.

FIG. 8 shows a top perspective view of the scraping layer of the first exemplary embodiment, displaying the scraping layer 13, the scraping edge 14, and the barbs 15.

FIG. 9 shows a side view of the scraping layer of the first exemplary embodiment, displaying the scraping layer 13, and the scraping edge 14.

FIG. 10 shows a top view of the scraping layer of the first exemplary embodiment, displaying the scraping layer 13, the scraping edge 14, and the barbs 15.

DETAILED DESCRIPTION OF THE INVENTION

Figure 1:
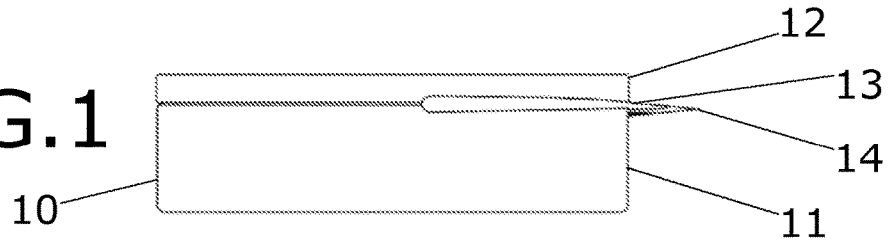
FIG. 1 shows a side view of the first exemplary embodiment, displaying the sponge 10, the sponge layer 11, the abrasive layer 12, the scraping layer 13, and the scraping edge 14.
Figure 2:
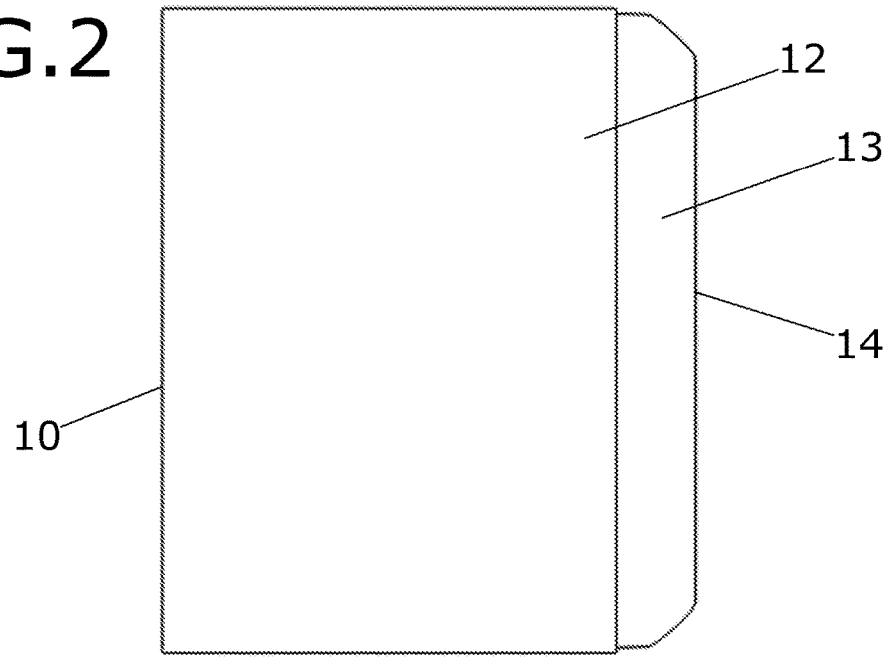
FIG. 2 shows a top view of the first exemplary embodiment, displaying the sponge 10, the sponge layer 11, the abrasive layer 12, the scraping layer 13, and the scraping edge 14.
Figure 3:
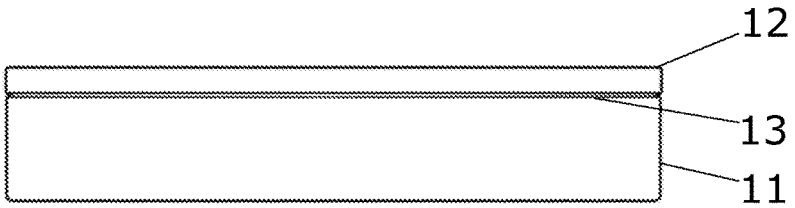
FIG. 3 shows a rear view of the first exemplary embodiment, displaying the sponge 10, the sponge layer 11, the abrasive layer 12, and the scraping layer 13.
Figure 4:
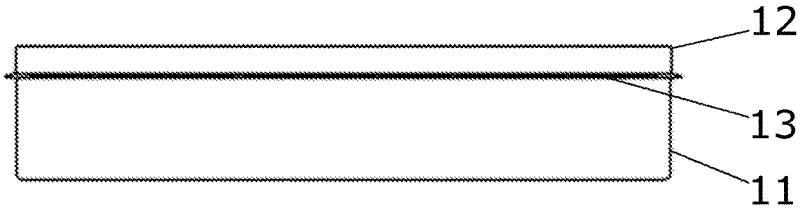
FIG. 4 shows a front view of the first exemplary embodiment, displaying the sponge 10, the sponge layer 11, the abrasive layer 12, and the scraping layer 13.
Figure 5:
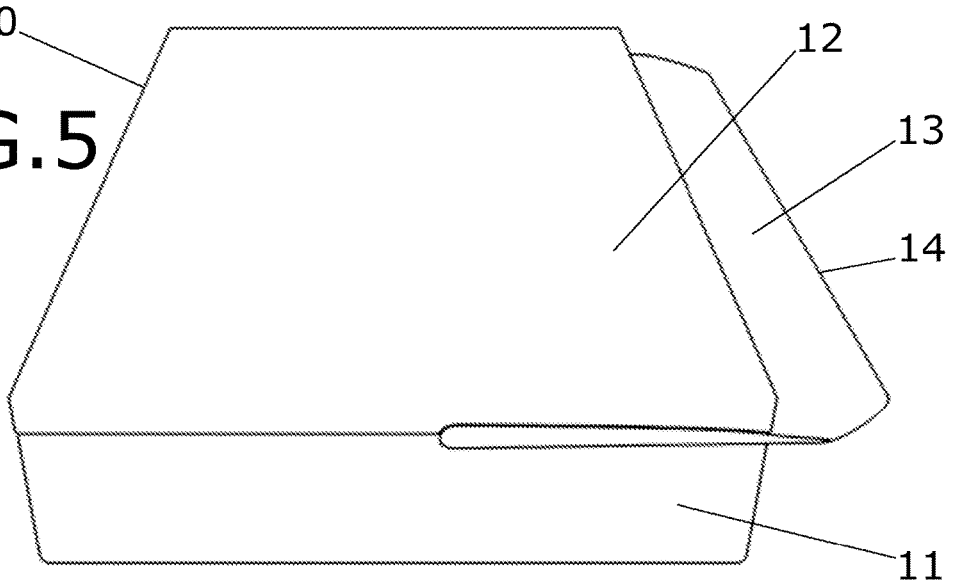
FIG. 5 shows a side perspective view of the first exemplary embodiment, displaying the sponge 10, the sponge layer 11, the abrasive layer 12, the scraping layer 13, and the scraping edge 14.
Figure 6:
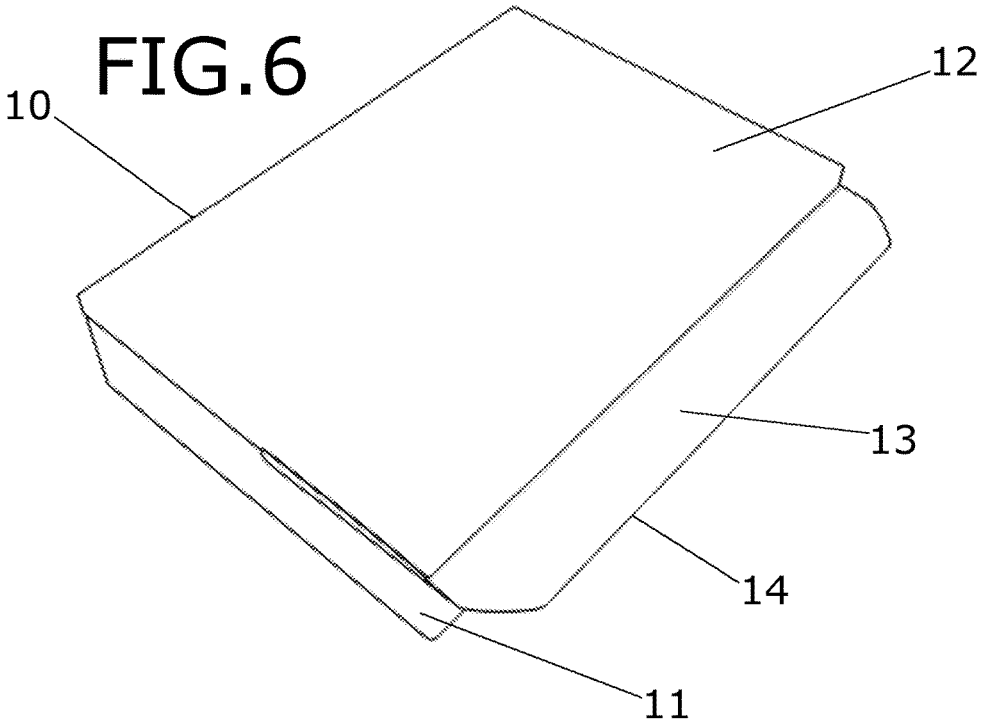
FIG. 6 shows a top perspective view of the first exemplary embodiment, displaying the sponge 10, the sponge layer 11, the abrasive layer 12, the scraping layer 13, and the scraping edge 14.

Referring now to the invention in more detail, the invention is directed to a scrubber/scraper sponge 10.

The first exemplary embodiment provides a sponge 10 which is comprised of three layers. A lower sponge layer 11 provides a soft, absorbent washing surface on the bottom surface of the sponge 10. An upper abrasive layer 12 provides a scrubbing surface on the top surface of the sponge 10. The front peripheral edge of the sponge 10 provides a scraping edge 14 on a scraping layer 13, which extends partially from the front edge toward the rear edge of the sponge 10, between the sponge layer 11 and the abrasive layer 12.

The thickness of the scraping layer 13 is greatest at the rear edge, tapering gently to the scraping edge 14. Flexible barbs 15 extend rearward from the rear edge of the scraping layer 13, such that the barbs 15 become embedded in the sponge layer 11 during the manufacturing process and firmly secure the scraping layer 13 to the sponge layer 11. Optionally, a version may be provided which does not provide the barbs 15. The scraping layer 13 may be removable and replaceable, since the scraping layer 13 sustains considerable wear and tear. All three layers are further secured together by application of an adhesive during the manufacturing process.

To use the first exemplary embodiment, the user grasps the sponge 10 between the thumb and fingers of one hand, and grasps a dish to be washed in the other hand. The user may use the scraping edge 14 to scrape unwanted food and other debris from the dish to be washed, then wash the dish using the sponge layer 11 and the abrasive layer 12, The sponge layer 11 is preferably manufactured from a flexible, durable material which is highly absorbent, such as natural sponge. The abrasive layer 12 is preferably manufactured from a flexible, durable material which is abrasive, such as nylon fibers. The scraping layer 13 is preferably manufactured from a flexible, durable material such as plastic, rubber, or silicone. Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A scrubber/scraper sponge which provide three layers, comprising:

a lower sponge layer which provides a soft, absorbent washing surface on a bottom surface of the sponge;

an upper abrasive layer which provides a scrubbing surface on a top surface of the sponge;

a scraping layer which is positioned at least partially in between the lower sponge layer and the upper abrasive layer, the scraping layer having a rear edge positioned between the lower sponge layer and the upper abrasive layer and the front edge extending outward from the sponge, in which the scraping layer tapers from the rear edge in between the lower sponge layer and the upper abrasive layer to the front edge of the scraping layer; and extensions that are secured to and which extend from the rear edge of the scraping layer, wherein each extension includes barbs that embed in at least the lower sponge layer to secure the scraping layer to the sponge, in which the extensions and barbs are positioned between the lower sponge layer and the upper abrasive layer.

2. The scrubber/scraper sponge of claim 1, wherein the front edge of the scraping layer protrudes from a front peripheral edge of the sponge.

3. The scrubber/scraper sponge of claim 1, wherein the scraping layer provides a scraping edge on the front edge.

4. The scrubber/scraper sponge of claim 1, wherein the upper abrasive layer, scraping layer, and lower sponge layer are further secured together by application of an adhesive during the manufacturing process.

5. The scrubber/scraper sponge of claim 1, wherein the sponge layer is comprised of a flexible, durable, and absorbent material.

6. The scrubber/scraper sponge of claim 1, wherein the abrasive layer is comprised of a flexible, durable, and abrasive material.

7. The scrubber/scraper sponge of claim 1, wherein the scraping layer is comprised of a flexible and durable material.

* * * * *